US010935315B2

(12) United States Patent
Di Lucrezia

(10) Patent No.: US 10,935,315 B2
(45) Date of Patent: Mar. 2, 2021

(54) DRYING PLANTS FOR PAINTED OBJECTS

(71) Applicant: Geico S.p.A., Cinisello Balsamo (IT)

(72) Inventor: Alessandro Di Lucrezia, Cinisello Balsamo (IT)

(73) Assignee: GEICO S.p.A., Cinisello Balsamo (IT)

( * ) Notice: Subject to any disclaimer, the term of this patent is extended or adjusted under 35 U.S.C. 154(b) by 100 days.

(21) Appl. No.: 16/317,246

(22) PCT Filed: Jul. 14, 2017

(86) PCT No.: PCT/IB2017/054271
§ 371 (c)(1),
(2) Date: Jan. 11, 2019

(87) PCT Pub. No.: WO2018/015855
PCT Pub. Date: Jan. 25, 2018

(65) Prior Publication Data

US 2019/0316841 A1 Oct. 17, 2019

(30) Foreign Application Priority Data

Jul. 18, 2016 (IT) ..... 102016000074962

(51) Int. Cl.
*F26B 15/14* (2006.01)
*F26B 23/02* (2006.01)
(Continued)

(52) U.S. Cl.
CPC ..... *F26B 15/14* (2013.01); *F26B 23/022* (2013.01); *F26B 21/004* (2013.01); *F26B 21/04* (2013.01);
(Continued)

(58) Field of Classification Search
CPC ..... F26B 15/14; F26B 23/022; F26B 21/004; F26B 21/04; F26B 25/006; F26B 2210/12; F26B 3/06; F26B 15/18; F26B 21/10
See application file for complete search history.

(56) References Cited

U.S. PATENT DOCUMENTS 5,165,969 A 11/1992 Barlett et al.
2012/0260518 A1* 10/2012 Melgaard ..... F26B 21/004 34/412
(Continued)

FOREIGN PATENT DOCUMENTS

CN 101678573 A 3/2010
CN 104583699 A 4/2015
(Continued)

OTHER PUBLICATIONS

International Search Report and Written Opinion dated Sep. 19, 2017, in International Application No. PCT/IB2017/054271, 9 pages.
(Continued)

*Primary Examiner* — Jessica Yuen
(74) *Attorney, Agent, or Firm* — MH2 Technology Law Group LLP

(57) ABSTRACT

A plant for drying objects which release volatile substances may include: a drying tunnel; a conveying system configured to convey the objects through the drying tunnel; a plurality of sensors arranged along the drying tunnel; and/or a plurality of air exchange units. The sensors may be configured to measure a concentration of the volatile substances along the drying tunnel. The air exchange units may be controlled by the sensors to keep the concentration of the volatile substances in the drying tunnel below a pre-established value. A method for keeping volatile substances below a pre-established value within a plant for drying
(Continued)

objects may include: measuring with sensors concentration of the volatile substances at points along the drying tunnel; and/or operating air exchange units, according to the concentration of the volatile substances measured by the sensors, to keep the concentration of the volatile substances in the drying tunnel below the pre-established value.

20 Claims, 2 Drawing Sheets

(51) Int. Cl.
*F26B 21/00* (2006.01)
*F26B 21/04* (2006.01)
*F26B 25/00* (2006.01)

(52) U.S. Cl.
CPC ..... *F26B 25/006* (2013.01); *F26B 2210/12* (2013.01)

(56) References Cited

U.S. PATENT DOCUMENTS

| | | | |
|---|---|---|---|
| 2015/0121720 | A1 | 5/2015 | Wieland et al. |
| 2015/0367371 | A1 | 12/2015 | Fernholz et al. |

FOREIGN PATENT DOCUMENTS

| | | | |
|---|---|---|---|
| DE | 10 2010 030 280 | A1 | 12/2011 |
| EP | 2 360 443 | A1 | 8/2011 |
| WO | 2008/144427 | A1 | 11/2008 |
| WO | 2013156105 | A1 | 10/2013 |

OTHER PUBLICATIONS

Chinese Office Action in corresponding Chinese Application No. 201780044458.9, dated Apr. 14, 2020, 18 pages.

* cited by examiner

DRYING PLANTS FOR PAINTED OBJECTS

CROSS-REFERENCE TO RELATED APPLICATION(S)

This application is a national stage entry from International Application No. PCT/IB2017/054271, filed on Jul. 14, 2017, in the Receiving Office ("RO/IB") of the World Intellectual Property Organization ("WIPO"), published as International Publication No. WO 2018/015855 A1 on Jan. 25, 2018, and claims priority under 35 U.S.C. § 119 from Italian Patent Application No. 102016000074962, filed on Jul. 18, 2016, in the Italian Patent and Trademark Office ("IPTO"), the entire contents of all of which are incorporated herein by reference.

The present invention relates to an innovative drying plant for objects, in particular motor vehicle frames, or parts thereof, or bodies. The invention also relates to a method for keeping the concentration of volatile substances below a pre-established value.

In the field of continuous production of painted objects, such as motor vehicle frames or parts thereof, tunnel ovens are commonly used for drying paint applied to objects which arrive, in sequence, at the tunnel entrance and exit, at the opposite end, dry. In such ovens, appropriately heated air is recirculated, while the objects are conveyed from the tunnel entrance end to the exit end. For example, air circulation heaters can be provided at intervals along the tunnel, whose length will depend on the length of the treatment and the desired conveying speed.

During the drying process, volatile substances usually develop, which gradually evaporate from the paint and can also be flammable or explosive if in concentrations above a safety limit (known as the LEL: Lower Explosion Limit).

For this reason, the air in the oven must be exchanged regularly in order to prevent the safety limit for volatile substances being exceeded. For example, air can enter or be forced into the tunnel from the ends thereof and extracted from the centre.

However, the need for the exchange of air will increase the oven's energy usage, as the air taken in from the outside must not cool the tunnel and therefore needs to be heated accordingly. Furthermore, this exchange involves handling high volumes of outgoing air, to remove the dangerous volatile substances therefrom prior to releasing the air into the environment or circulating it back into the oven.

Nevertheless, in order to be sure of avoiding dangerous concentrations of volatile substances in any condition, the flow of air within drying tunnels according to the commonly known technique is generally kept relatively high, even far beyond that deemed, theoretically, sufficient.

In fact, the amount of volatile substances varies, obviously, depending on the number of objects to be dried simultaneously in the tunnel and the frequency of the entrance thereof. For safety's sake, the exchange is scaled for the maximum number envisaged (e.g. 200-250 kg/frame) and the exchange takes places, therefore, with the established volume of air even if there are no objects in the oven or those present are much less than the oven's capacity.

Prior art documents have suggested making the air circulation depend on the number of objects in the tunnel. For example, it has been suggested that the ingoing objects be counted and then the air circulation be increased or decreased depending on the greater or smaller number of objects entering during the unit of time.

For example, US2015/121720 relates to a drying tunnel equipped with frame passage sensors to establish the number of frames in the tunnel and adjust the total circulation. The system also envisages the use of a single solvent detection sensor at one point of a tunnel point.

EP2360443 also relates to the measurement of the concentration of pollutants at the centre of a drying tunnel in order to change the air exchange rate.

In both cases the amount of recirculated air must always be kept high to ward off the danger of overly high concentrations of pollutants at any point in the tunnel.

However, this way of proceeding presents some drawbacks. For example, the dispersion of volatile substances may not be linear along the tunnel, and may also vary unproportionally to the number of objects in the tunnel, or the objects may reach the tunnels at different intervals from one to the next, creating zones with higher or lower concentrations of volatile substances in the tunnel. Even when tracking the position of the objects in the tunnel, in order to avoid underestimating, in certain conditions, the need for air exchange, a greater air exchange than would actually be necessary must nevertheless be maintained.

Furthermore, the system is very sensitive to changes of paint or of the type of objects treated (e.g. vehicle frames with different shapes and/or sizes) and it would therefore be necessary to recalibrate the system at each change of processing or—as it is common practice—to settle for an approximate calibration with a good margin of safety. With this system, it is also impossible to handle, contemporaneously and efficiently, multiple objects of different kinds or with different types of painting, which arrive at the tunnel in mixed groups or in any order. In fact, in these cases, the amount of volatile substances released along the tunnel varies greatly with the same number of objects in the tunnel and the amount of excess air needed to ensure a margin of safety to prevent the concentration of volatile substances in all sections of the tunnel is high.

US2015/367371, U.S. Pat. No. 5,165,969, and DE102010030280 relate to painting booths with a single sensor for measuring the concentration of the solvents in the booth. As the concentration of solvents in the booth is higher and the extraction, generally speaking, is centralised, the measurement can be significant. However, this system becomes completely unreliable in the case of drying tunnels.

The general aim of the present invention is to provide a drying tunnel and management method which minimise the amount of spare air employed in the tunnel so as to reduce energy usage and the need for air handling.

In view of this aim, it was decided to produce, according to the invention, a plant according to claim 1.

In particular, a plant may preferably be envisaged for drying objects which release volatile substances, comprising a drying tunnel with a conveying system which conveys the objects through the tunnel, characterised by the fact that sensors are arranged along the tunnel for measuring the concentration of volatile substances along the tunnel, together with air exchange units controlled by the sensors so as to keep the concentration of volatile substances in the tunnel below a pre-established value.

Also according to the invention, it was decided to produce a method according to claim 11.

In particular, a method may preferably be envisaged for keeping volatile substances below a pre-established level within a plant for drying objects which release volatile substances, which comprises a drying tunnel with a conveying system which conveys the objects through the tunnel, characterised by the fact that said method involves measuring, with sensors, the concentration of volatile substances along the tunnel and controlling air exchange units arranged along the tunnel, according to the concentrations measured, in order to keep the concentration of volatile substances in the tunnel below a pre-established value.

To provide a clearer explanation of the innovative principles of the present invention and the advantages thereof with respect to the commonly known technique, exemplifying embodiments in which said principles are applied will be described below, with the help of the accompanying drawings. In the drawings.

Figure 1:
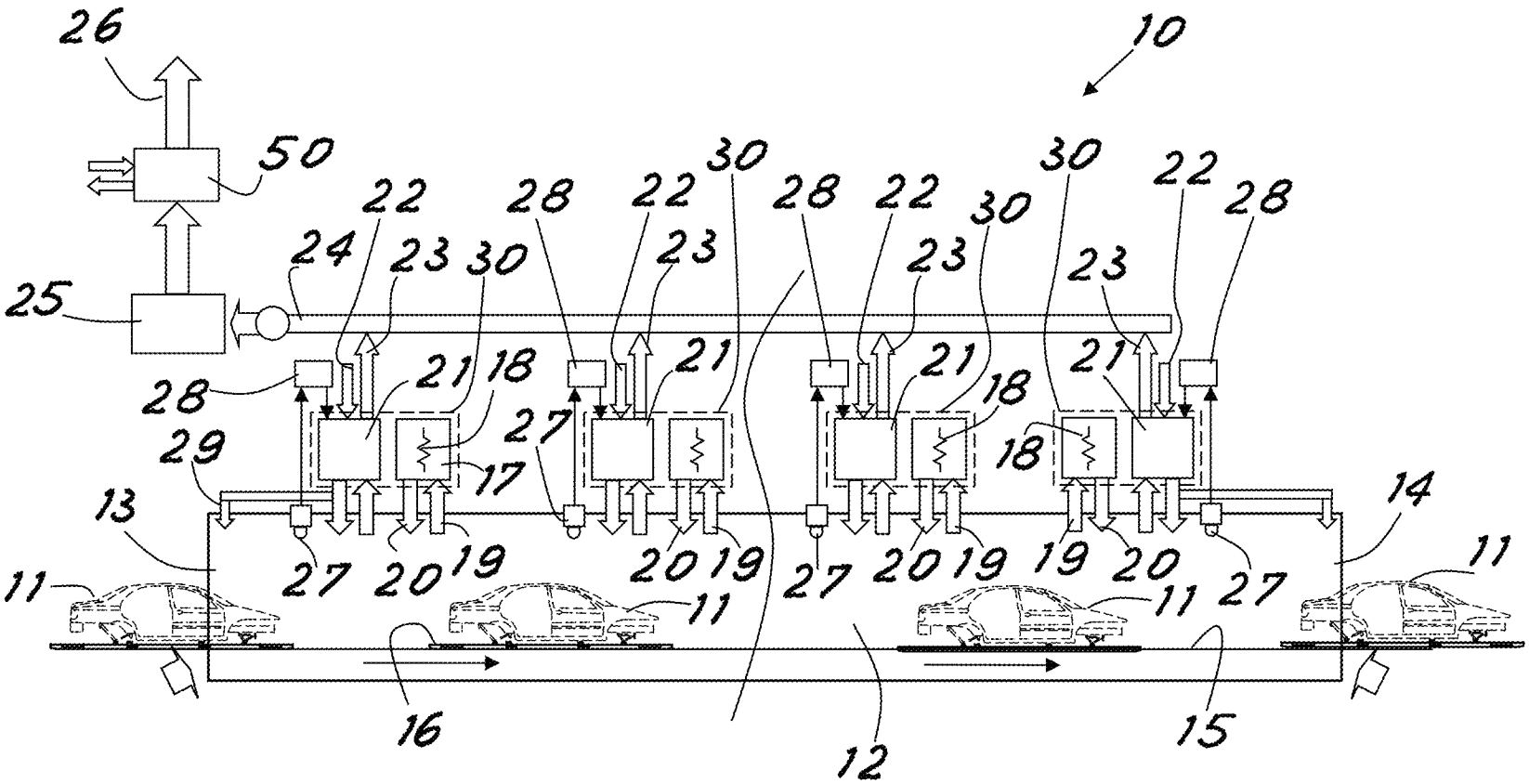
FIG. 1 is a schematic view of a drying tunnel according to the invention.

With reference to the figures, FIG. 1 shows a drying plant as a whole, denoted by 10, produced according to the present invention, for drying objects 11.

The plant 10 comprises a drying tunnel or oven 12 with an entrance 13 at one end and an exit 14 at the opposite end and a commonly known conveying system 15 (e.g., a sequential chain conveyor line or suchlike) which conveys objects 11 from the entrance 13 to the tunnel exit 14 at a desired speed.

The individual objects 11 can be, for example, motor vehicle frames or parts thereof or bodies, and can be supported on appropriate commonly known conveying frames or skids 16. Objects will reach the tunnel after a treatment (e.g. painting) which requires a drying process during which volatile substances can develop which need to be kept below a pre-established concentration inside the tunnel. For example, such volatile substances may be substances which are dangerous, explosive, or flammable above a given concentration limit (LEL).

Systems for internal tunnel heating are envisaged in order to have the desired temperature in the tunnel for the process one wishes to carry out.

For example, a plurality of heating and circulation units 17 may be advantageously arranged along the tunnel, which heat the air in the tunnel appropriately in order to keep the tunnel, or the various sections thereof, at a desired temperature which is suitable for the heat treatment desired for the objects 11.

The units 17 are, advantageously, external to the tunnel and each one thereof can include, for example, a heater 18 (for example, an electric heater, thermal fluid heater, or a burner heater) which heats an air flow which is extracted from the interior of the tunnel and returned to the tunnel after heating, by means of extraction 19 and input 20 conduits. The circulation can be forced by means of an appropriate, commonly known circulation fan (not shown).

The units 17 can be advantageously arranged along the tunnel, with appropriate intervals therebetween, and in a desired quantity, so as to achieve a desired temperature profile along the tunnel. The temperature will be controlled according to an appropriate commonly known control system, which will suitably regulate the heater and/or the circulation fan, for example by means of a suitable commonly known temperature sensor and a feedback control, as can easily be imagined by a person skilled in the art.

The tunnel also includes air exchange units 21 for extracting spent air from the tunnel and forcing a flow of clean or purified air (coming from an external source 22, for example, the factory, a filtration unit or a preheater) into the tunnel so as to ensure the exchange of air in the tunnel. The air extracted from the tunnel by each unit 21 is directed through a conduit 23 and 24 to a handling device 25 to eliminate the desired volatile components from the flow of air before evacuating the air from the plant through an outlet 26. The handling device 25 will depend on the type of volatile components to be removed.

The heater 18 (e.g., heating element) can be an integral part of the air exchange unit 21 and the two separate sets of entrance and exit channels 19 and 20 in each heating and circulation unit 17 may also not be envisaged.

Advantageously, the device 25 can, for example, be produced with or comprise a commonly known incinerator with a temperature suitable for burning volatile components. Appropriate commonly known filters can also be employed to abate the fumes produced.

Before the exit 26 there may also be a commonly known thermal energy recovery device 50 envisaged, which recovers the thermal energy present in the flow of air and/or the fumes and which can be employed, for example, to heat other parts of the plant.

Each air exchange unit 21 is preferably associated with a sensor 27 which measures the concentration of volatile substances near the unit and, through a control unit 28, controls the exchange of air in order to keep the concentration of volatile substances below a pre-established danger level.

In other words, a plurality of sensors 27 are arranged distribute so as to be in contact with the air as it flows through the tunnel in order to provide a measurement of the trend of the concentration of solvents along the tunnel. Air exchange units arranged distribute along the tunnel are controlled according to the concentration trend of solvents along the tunnel so as to keep such concentration low enough along the length of the tunnel.

Preferably, the concentration will be kept at a level which is below the danger level but, at the same time, sufficiently high to be able to fuel combustion in the handling device 25 (e.g., incinerator) without the need for, or with a limited need for, other fuel. This results in a reduction in energy requirements. For example, the sensor can be located in the tunnel or in the flow of air which is recirculated, for heating purposes, in the heating and circulation unit 17.

The first and the last air exchange units 21 can also have the air intake conduit connected to a further conduit 29 which directs air near the tunnel entrance and exit, respectively, to create a barrier preventing the exchange of air with the exterior at the tunnel entrance and exit. The tunnel can also be kept slightly depressurised by means of the air exchange unit 21 so as to prevent polluted air being released from the tunnel ends.

The units 17 and 21 can also be produced as a single heating and air exchange unit 30. This allows the flow of air and the connection to the tunnel 12 to be optimised. For example, it is possible to have just one extraction conduit and one input conduit serving both the heating unit 17 and the air exchange unit 21.

Figure 2:
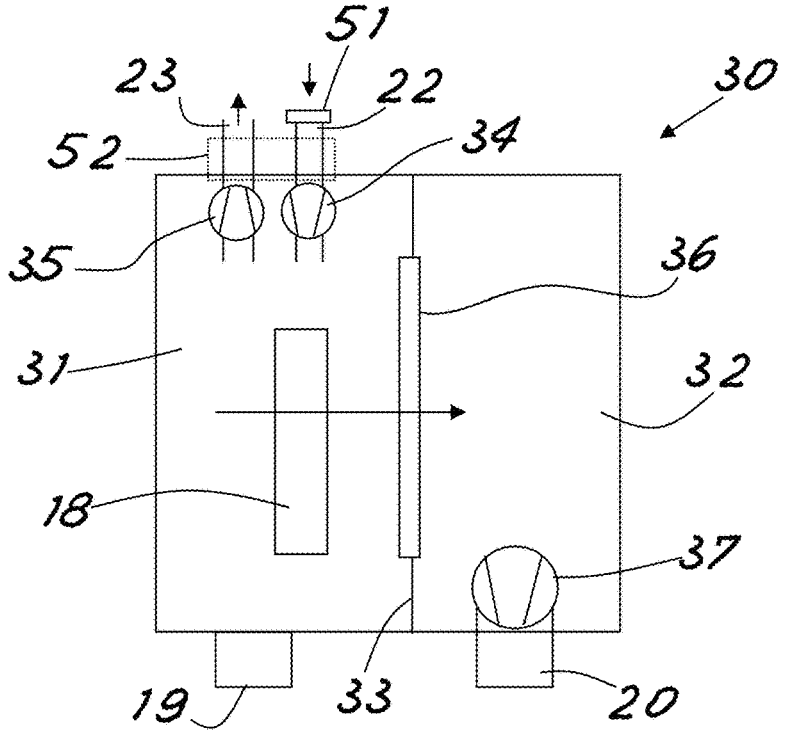
FIGS. 2 and 3 show schematic views of the two possible embodiments of a part of the plant according to the present invention.

FIG. 2 shows, schematically, a first possible embodiment of a single heating and air exchange unit 30.

This first embodiment comprises a first and a second chamber 31, 32, for example, produced in the form of a parallelepiped box divided into two parts 31, 32 by means of a partition 33. One of the two parts or chambers is reached by the conduit 19, which extracts the air from the tunnel, and by the two spent air exchange conduits 22 and 23, which are served, respectively, by fans 34, 35. Advantageously, a filter 51 can be added at the inlet of the conduit 22.

In the part 31 or the heating chamber 31, the air is heated (advantageously with the heater 18 which can be located in the chamber) so as to heat the incoming air, which is then sent, preferably through a filter 36, to the second part or chamber 32, where there is, for example, a circulation fan 37 present. Air is extracted at least partially from the first part 31 and sent to the tunnel through the conduit 20.

The two fans 34, 35, for the extraction of the fresh air and the evacuation of the spent air, can be controlled according to the measurement obtained via a sensor 27 (for example by means of the control unit 28 and a sensor 27) so as to keep the air recirculated in the tunnel by the unit 30 at the pre-established level of volatile substances.

Preferably, the evacuation fan 35 can be controlled according to a first minimum flow rate value and a maximum flow rate value, wherein the minimum value must not be zero, while the extraction fan 34 can be controlled according to a minimum flow rate (for example, zero) below the first minimum value of the evacuation fan 35, and a maximum value equal to the maximum value of the evacuation fan 35. In this way, it is possible to keep the tunnel depressurized and regulate the air exchange at the same time.

For example, the circulation fan 37 can have a set flow rate (for example, approximately 50,000 $m^3$/hr), while the evacuation fan 35 can be controlled with a rate ranging from a minimum (for example, 2,000 $m^3$/hr) to maximum value (for example, 3,000 $m^3$/hr), and the extraction fan 34 can be controlled with a rate ranging from a minimum of 0 $m^3$/hr to a maximum value (for example, 3,000 $m^3$/hr).

The incoming fresh air and the spent air may also flow through a heat exchanger 52 to recover part of the heat from the spent air and preheat the incoming air.

Figure 3:
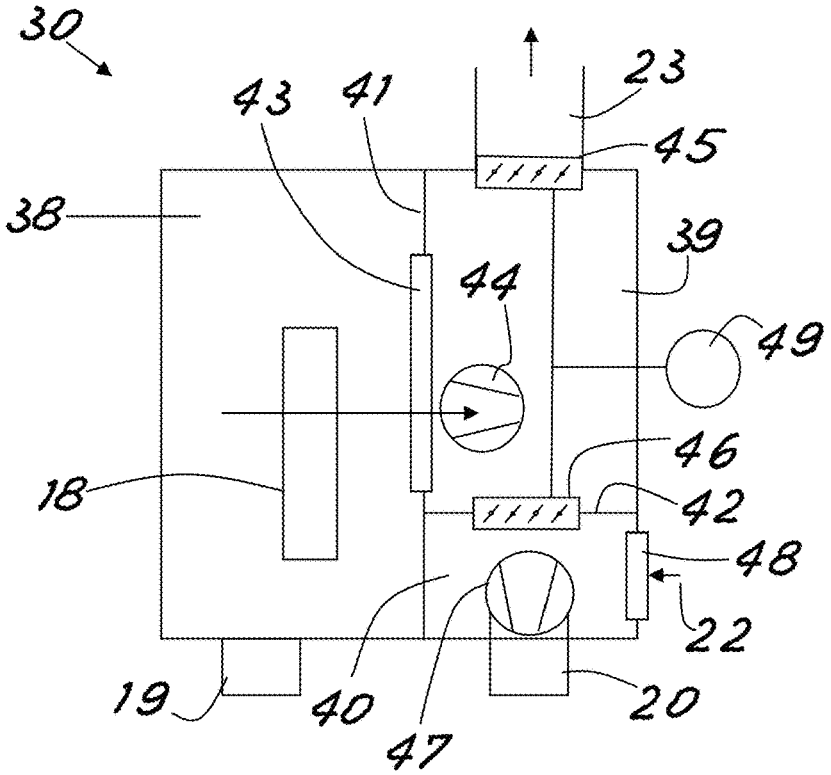

FIG. 3 shows, schematically, a second possible embodiment of a single heating and air exchange unit 30.

This second embodiment comprises a first, a second and a third chamber 38, 39, 40, produced, for example, in the form of a parallelepiped box divided into three parts 38, 39, 40 by means of a partitions 41 and 42. The part 38 or heating chamber is reached by the conduit 19 which extracts the air from the tunnel and the air is heated therein, for example, by means of the heater 18 located in the chamber.

After the heating, the incoming air is sent, preferably through a filter 43, to the second part 39 or first air exchange chamber. For the passage of the air from the first to the second chamber there is, for example, an extraction fan 44 which extracts the air from the first part 38.

The second part or chamber 39 is connected to the evacuation conduit 23 through a first shutter 45 and, through a second shutter 46, to the third part 40 or second air exchange chamber. Air is extracted from the third part and then sent on to the tunnel through a conduit 20. For example, in the third chamber there is a circulation fan 47 present which extracts the air from the second part 39. The third part 40 is connected with the exterior, advantageously, through a filter 48, to provide the inlet 22 for the fresh air. The first shutter 45 and the second shutter 46 are controlled according to the concentration measured by a plurality of sensors 27.

For example, the two shutters are advantageously interlaced and moved by an actuator 49 (or one actuator for each shutter). The two shutters are therefore controlled by the control unit 28 and the sensor 27 so that the flow coming from the heating chamber 38 can be either completely recirculated or partly ejected.

The air flowing through the shutter 45 is preferably destined for the incinerator as it is spent air, and the flow rate thereof is regulated by the shutters, as described above, which in turn are operated by the LEL control on the return air pipe.

Since the fan 47 (which guarantees the delivery to the tunnel) preferably requires a constant flow, it replaces the part of spent air expelled through the shutter 45 by taking in fresh air via the inlet 22, and said fresh air is mixed with the recirculated air which has not been expelled and then sent into the tunnel through the conduit 20.

Controlling the two shutters, the control unit 28 and a sensor 27 can therefore keep the air circulated in the tunnel by the unit 30 at the pre-established level of volatile substances.

As an alternative to the use of shutters, an inverter or Variable Frequency Drive (VFD) can be employed which manages the extraction fan 44 to control the flow from the first chamber 38 to the second chamber 39, and to manage the air recirculation and exchange. The variation in the extraction fan speed makes the extraction air flow rate equal to or greater than that of the flow rate of the fan delivering air to the tunnel. When the flow rate is equal, the system is in perfect recirculation mode. When the extraction flow rate is greater, the excess air is directed into the channel towards the spent air outlet conduit 23 as a result of the excess pressure.

If the shutter 46 is not present, the partition wall 42 may also be left out and the two chambers 39, 40 can become essentially a single space.

At this point, it is clear how the intended aims are achieved.

With the LEL control arranged along the tunnel, it is possible to supply fresh air continuously and solely in the areas of the oven actually concerned by the evaporation of solvents.

Furthermore, the regulation can be kept very precise, without the need for broad safety margins and with a pre-established solvent concentration which allows the air containing combustible solvents to be sent to the incinerator, possibly in sufficient quantities to maintain the incinerator flame without needing to supply the latter with gas, thereby reducing usage thereof. As can be seen from the description above, the distance between the measuring points of the sensors arranged along the tunnel will advantageously be chosen to be sufficiently low to prevent there being zones in the tunnel which are not sufficiently monitored. Likewise, the recirculation units can be kept sufficiently reciprocally close to prevent there being zones in the tunnel with insufficient air exchange. The system according to the invention ensures the air exchange along the tunnel is really proportional to the actual quantity of solvents present in the tunnel. This makes is possible to greatly limit the air needed to be recirculated and/or extracted and replaced in the tunnel. The possible structures of the air exchange units described above have been found to be particularly advantageous in achieving a plurality of compact, efficient units.

Naturally, the description set out above of an embodiment applying the innovative principles of the present invention is given by way of example of such innovative principles and therefore must not be deemed a limitation of the patent right claimed here. For example, other types of processing requiring the drying of objects in a tunnel which involve the development of volatile substances whose concentrations have to be limited within the tunnel may benefit from the system described, although the plant according to the invention has been found to be particularly advantageous in the case of painting motor vehicle frames or parts thereof or bodies.

Other embodiments of the air heating and exchange units may be devised on the basis of the description herein, while remaining within the scope of the present invention.

The invention claimed is:

1. A plant for drying objects which release volatile substances, the plant comprising:

a drying tunnel;

a conveying system configured to convey the objects through the drying tunnel;

a plurality of sensors arranged along the drying tunnel; and a plurality of air exchange units;

wherein the sensors are distributed along the drying tunnel to be in contact with air flowing through the drying tunnel and configured to measure a distribution trend of a concentration of the volatile substances along the drying tunnel, and wherein the air exchange units are distributed along the drying tunnel so that each of the air exchange units exchanges air in an associated zone along the drying tunnel, the air exchange units being controlled by the sensors according to the distribution trend of the concentration of the volatile substances along the drying tunnel to keep the concentration of the volatile substances in the drying tunnel below a pre-established value.

2. The plant of claim 1, further comprising:

heating and circulation units arranged along the drying tunnel;

wherein, using a heater, the heating and circulation units are configured to heat the air in the drying tunnel in order to keep various sections of the drying tunnel at desired temperature.

3. The plant of claim 2, wherein a respective one of the air exchange units and a respective one of the heating and circulation units are paired in an air heating and exchange unit.

4. The plant of claim 3, wherein the air heating and exchange unit comprises:

a boxed body divided into a first chamber and a second chamber which are interconnected;

a heater configured to heat air in the first chamber; and first, second, and third fans;

wherein air is extracted from the drying tunnel via a first conduit into the first chamber, wherein the first fan is configured to remove spent air from the first chamber via a second conduit, wherein the second fan is configured to introduce clean air into the first chamber via a third conduit, wherein the first and second fans are controlled according to the concentration of the volatile substances measured by a respective one of the sensors, and wherein the third fan is configured to extract the air from the first chamber and to send the air extracted from the first chamber through the second chamber and into the drying tunnel via a fourth conduit.

5. The plant of claim 4, wherein the first and second chambers are interconnected through a filter.

6. The plant of claim 3, wherein the air heating and exchange unit comprises:

a boxed body divided into a first chamber, a second chamber, and a third chamber which are interconnected in sequence;

a heater configured to heat air in the first chamber;

first and second fans; and first and second shutters;

wherein air is extracted from the drying tunnel via a first conduit into the first chamber, wherein the first fan is configured to move the air in the first chamber to the second chamber, wherein the first shutter is configured to let spent air out from the second chamber via a second conduit, wherein clean air is introduced into the third chamber via a third conduit, wherein the first and second shutters are controlled according to the concentration of the volatile substances measured by a respective one of the sensors, and wherein the second fan is configured to extract the air from the second chamber and to send the air extracted from the second chamber through the third chamber and into the drying tunnel via a fourth conduit.

7. The plant of claim 6, wherein the first and second chambers are interconnected through a filter.

8. The plant of claim 6, wherein the second and third chambers are interconnected through the second shutter.

9. The plant of claim 1, wherein when controlled by an associated one of the sensors, each of the air exchange units extracts spent air from the drying tunnel and sends clean air into the drying tunnel.

10. The plant of claim 9, wherein each of the air exchange units is configured to send the spent air to a handling unit for elimination of the volatile substances from the spent air.

11. The plant of claim 10, wherein the handling unit comprises an incinerator.

12. The plant of claim 11, wherein the incinerator is at least partially fueled by the volatile substances in the spent air.

13. The plant of claim 11, further comprising:

a thermal energy recovery device at an outlet of the incinerator.

14. A method for keeping volatile substances below a pre-established value within a plant for drying objects which release the volatile substances, the plant comprising a drying tunnel with a conveying system which conveys the objects through the drying tunnel, the method comprising:

measuring, with a plurality of sensors, distribution trend of a concentration of the volatile substances at points distributed along the drying tunnel; and operating a plurality of air exchange units arranged distributed along the drying tunnel so that each of the air exchange units exchanges air in an associated zone along the drying tunnel, and controlling the air exchange units according to the distribution trend of the concentration of the volatile substances measured by the sensors, to keep the concentration of the volatile substances along the drying tunnel below the pre-established value.

15. The method of claim 14, wherein to keep the concentration of the volatile substances in the drying tunnel below the pre-established value, the air exchange units are controlled to extract spent air from the drying tunnel and to send clean air into the drying tunnel, and wherein the spent air is sent to an incinerator to burn the volatile substances contained in the spent air.

16. The method of claim 15, wherein a difference in flow rate between the spent air from the drying tunnel and the clean air into the drying tunnel keeps the drying tunnel depressurized.

17. The method of claim 14, wherein an air heating and exchange unit, comprising a respective air exchange unit, comprises:

a body comprising a first chamber and a second chamber which are interconnected;

a heater configured to heat air in the first chamber; and first, second, and third fans;

wherein air is extracted from the drying tunnel via a first conduit into the first chamber, wherein the first fan is configured to remove spent air from the first chamber via a second conduit, wherein the second fan is configured to introduce clean air into the first chamber via a third conduit, wherein the first and second fans are controlled according to the concentration of the volatile substances measured by a respective one of the sensors, and wherein the third fan is configured to extract the air from the first chamber and to send the air extracted from the first chamber through the second chamber and into the drying tunnel via a fourth conduit.

18. The method of claim 14, wherein an air heating and exchange unit, comprising a respective air exchange unit, comprises:

a body comprising a first chamber, a second chamber, and a third chamber which are interconnected in sequence;

a heater configured to heat air in the first chamber;

first and second fans; and first and second shutters;

wherein air is extracted from the drying tunnel via a first conduit into the first chamber, wherein the first fan is configured to move the air in the first chamber to the second chamber, wherein the first shutter is configured to let spent air out from the second chamber via a second conduit, wherein clean air is introduced into the third chamber via a third conduit, wherein the first and second shutters are controlled according to the concentration of the volatile substances measured by a respective one of the sensors, and wherein the second fan is configured to extract the air from the second chamber and to send the air extracted from the second chamber through the third chamber and into the drying tunnel via a fourth conduit.

19. The method of claim 18, wherein the first and second chambers are interconnected through a filter.

20. The method of claim 18, wherein the second and third chambers are interconnected through a filter.

* * * * *